US008641102B2

(12) United States Patent
Wang

(10) Patent No.: US 8,641,102 B2
(45) Date of Patent: Feb. 4, 2014

(54) MULTISTAGE LOCK

(76) Inventor: Jui-Wen Wang, Keelung (TW)

( * ) Notice: Subject to any disclaimer, the term of this patent is extended or adjusted under 35 U.S.C. 154(b) by 517 days.

(21) Appl. No.: 12/915,202

(22) Filed: Oct. 29, 2010

(65) Prior Publication Data

US 2011/0248515 A1 Oct. 13, 2011

(30) Foreign Application Priority Data

Apr. 7, 2010 (TW) ..... 99110701 A

(51) Int. Cl.
*E05C 5/00* (2006.01)

(52) U.S. Cl.
USPC ..... 292/64; 292/347

(58) Field of Classification Search
USPC ..... 292/64, 1, 347; 49/142, 219, 394
See application file for complete search history.

(56) References Cited

U.S. PATENT DOCUMENTS

| | | | | | |
|---|---|---|---|---|---|
| 1,438,547 | A * | 12/1922 | O'Connor | ..... | 292/161 |
| 2,123,188 | A * | 7/1938 | Hurlbut | ..... | 292/196 |
| 5,098,139 | A * | 3/1992 | Larsson | ..... | 292/97 |
| 2002/0163208 | A1 * | 11/2002 | Quigley et al. | ..... | 292/302 |
| 2012/0047809 | A1 * | 3/2012 | Hemping et al. | ..... | 49/394 |

* cited by examiner

*Primary Examiner* — Carlos Lugo
*Assistant Examiner* — Mark Williams
(74) *Attorney, Agent, or Firm* — WPAT, P.C.; Anthony King

(57) ABSTRACT

A multistage lock has a stationary frame, an inner frame, an outer frame mounted between the stationary and inner frames, multiple stops mounted on the stationary and inner frames, two sliding panels mounted on the outer frame and a handle assembly connected to the sliding panels. Stopping protrusions of the stops selectively engage limiting protrusions on the sliding panels when the at least one handle is turned. Consequently, the inner and outer frames are selectively opened. The multistage lock has a simplified structure and allows people to decide whether a door panel (window) is open according to situations and weather outdoors.

4 Claims, 12 Drawing Sheets

MULTISTAGE LOCK

BACKGROUND OF THE INVENTION

1. Field of the Invention

The present invention relates to a multistage lock, especially to a multistage lock that opens an outer frame and an inner frame of a door (window) in series.

2. Description of the Prior Art(s)

Openings that are reserved on walls of a building allow people, light and wind to pass through. A door panel (window) is mounted on the building in the opening to selectively open or close the opening of the building. However, when a conventional door panel (window) is opened, the opening of the building is also totally opened. If indoor people are unaware of the outdoor situation before opening the conventional door (window), danger may happen; or when the conventional door (window) is unable to partly open due to outdoor weathers, a clean indoor environment may be ruffled by the wind.

In view of the abovementioned shortcomings, a conventional main door panel (window) having a conventional additional door panel (window) is designed to allow people to open the additional door panel (window) to determine the outdoor situation or to ventilate indoor air. However, since the conventional main door panel (window) and the conventional additional door panel (window) are driven respectively by two handle assemblies, lock mechanism for the conventional door panels (windows) is complicated.

To overcome the shortcomings, the present invention provides a multistage lock to mitigate or obviate the aforementioned problems.

SUMMARY OF THE INVENTION

The main objective of the present invention is to provide a multistage lock. The multistage lock has a stationary frame, an outer frame mounted in the stationary frame, an inner frame mounted in the outer frame, multiple stops mounted on the stationary and inner frames, two sliding panels mounted on the outer frame and a handle assembly connected to the sliding panels.

According to relative positions of stopping protrusions of the stops and limiting protrusions on the sliding panels, the limiting protrusions on the sliding panels selectively engage the stopping protrusions of the stops when the at least one handle is turned. Consequently, the inner and outer frames are selectively opened. The multistage lock has a simplified structure and allows people to decide whether a door panel (window) is open or not according to outdoor situations and weather conditions.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
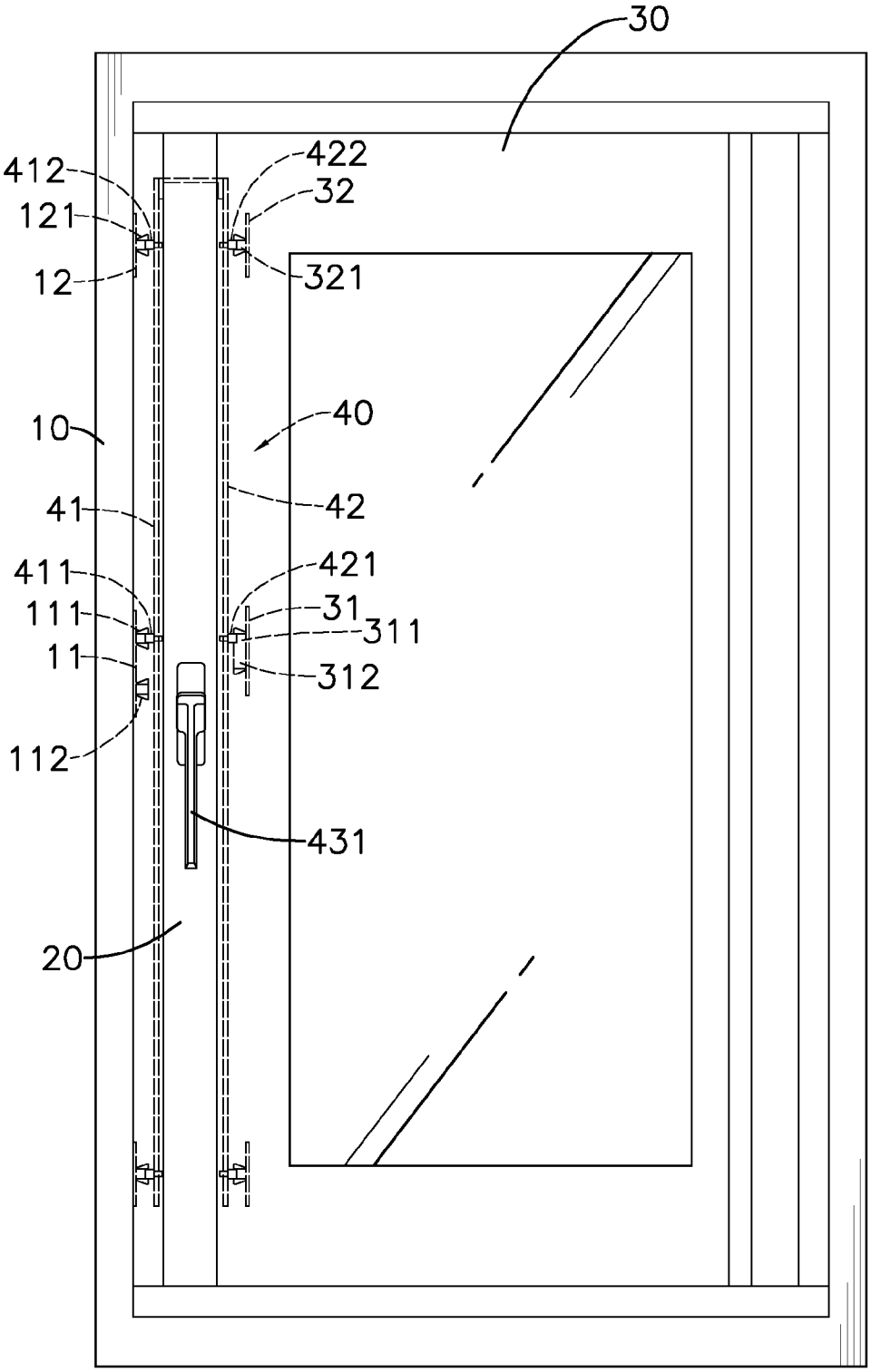
FIG. 1 is a front view of a first embodiment of a multistage lock in accordance with the present invention, shown a closed outer frame and inner frame.
Figure 3:
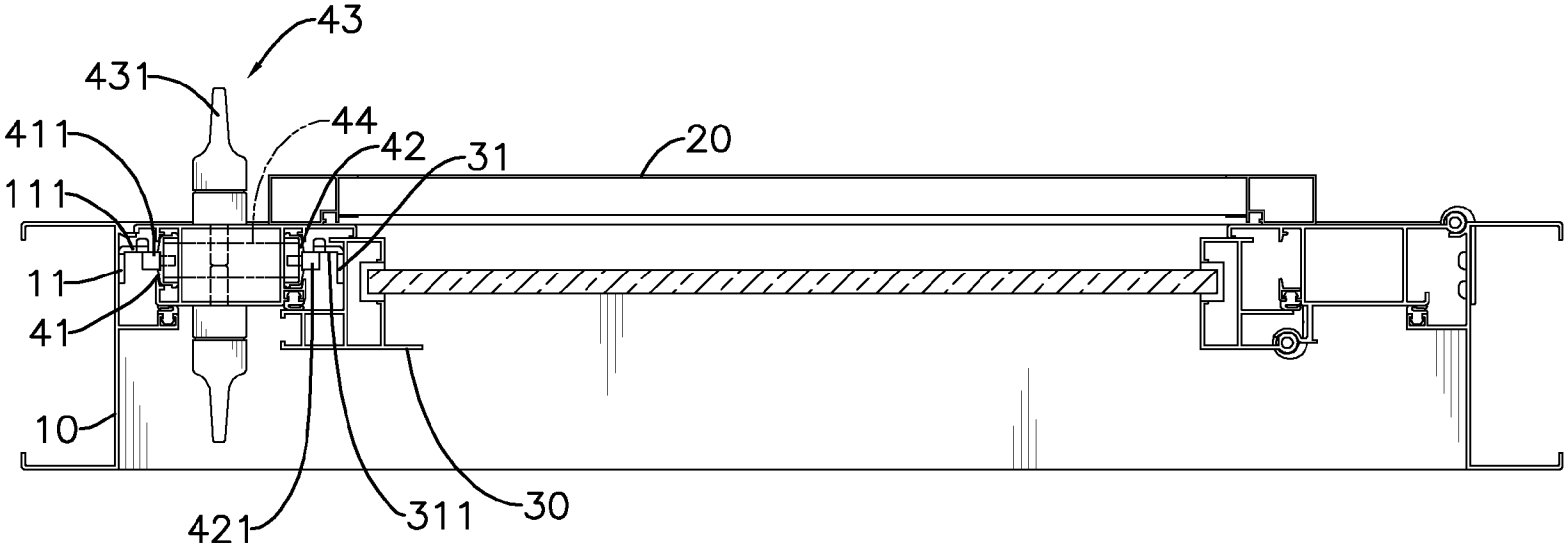
FIG. 3 is a top view in partial section of the multistage lock in FIG. 1, shown the closed outer frame and inner frame.

With reference to FIGS. 1 and 3, a first preferred embodiment of a multistage lock in accordance with the present invention is mounted in an opening formed through a building and comprises a stationary frame 10, an outer frame 20, an inner frame 30 and a lock device 40.

Figure 2:
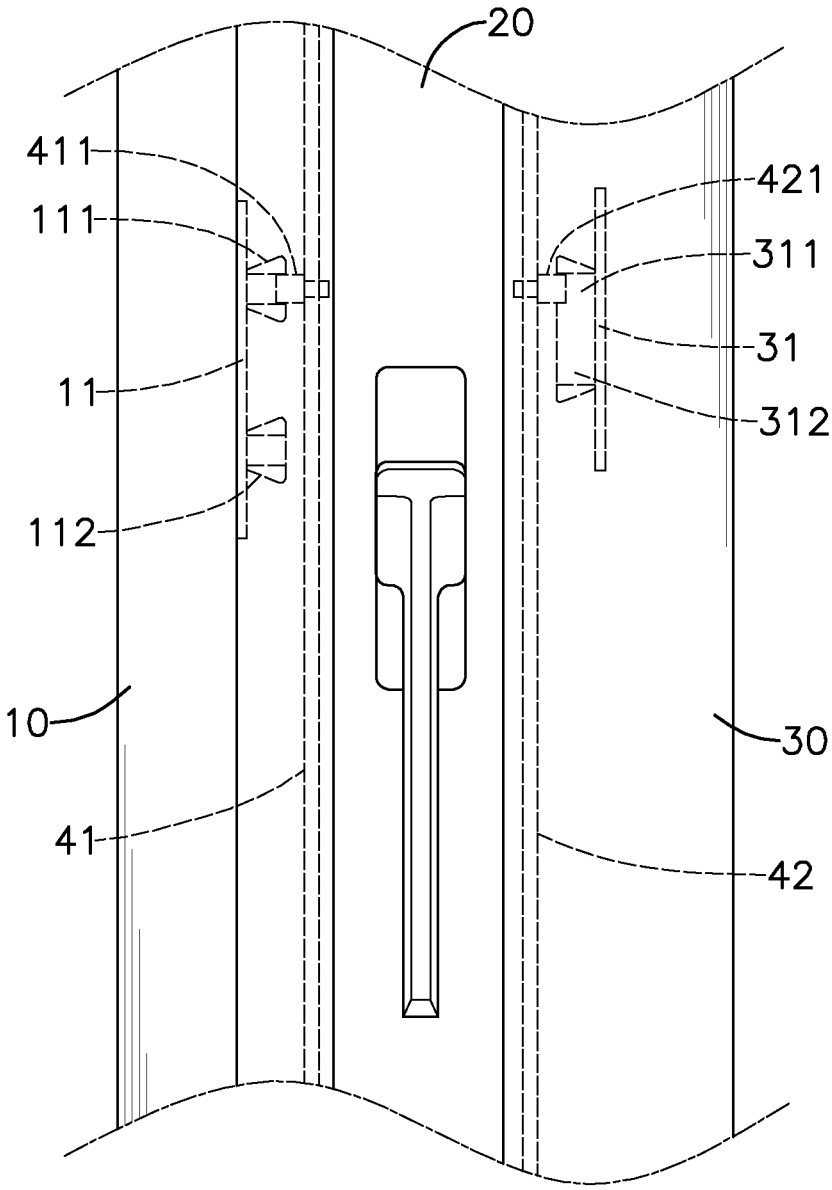
FIG. 2 is an enlarged front view of the multistage lock in FIG. 1, shown the closed outer frame and inner frame.

With further reference to FIG. 2, the stationary frame 10 is an annular framework, is mounted around an inner peripheral surface defined around the opening of the building and has an inner peripheral surface, at least one outer main stop 11 and at least one outer secondary stop 12.

The at least one outer main stop 11 is mounted securely on the inner peripheral surface of the stationary frame 10. Each of the at least one outer main stop 11 has a first stopping protrusion 111 and a second stopping protrusion 112. The first stopping protrusion 111 protrudes from the outer main stop 11. The second stopping protrusion 112 protrudes from the outer main stop 11 and is separated from the first stopping protrusion 111. Thus, a gap is defined between the first stopping protrusion 111 and the second stopping protrusion 112.

The at least one outer secondary stop 12 is mounted securely on the inner peripheral surface of the stationary frame 10 and is arranged longitudinally with the at least one outer main stop 11. Each of the at least one outer secondary stop 12 has an outer stopping protrusion 121 protruding from the outer secondary stop 12.

The outer frame 20 is an annular framework, is mounted in and connected pivotally to the stationary frame 10, and has an outer peripheral surface, an inner peripheral surface, a pivot stile and an open stile. The pivot stile of the outer frame 20 is connected pivotally to the stationary frame 10. The open stile of the outer frame 20 corresponds to the at least one outer main stop 11 and the at least one outer secondary stop 12. When the outer frame 20 pivots relative to the stationary frame 10, the open stile of the outer frame 20 is selectively closed and opened relative to the stationary.

The inner frame 30 is mounted in and is connected pivotally to the outer frame 20, and has an outer peripheral surface, a pivot stile, an open stile, at least one inner main stop 31 and at least one inner secondary stop 32. The pivot stile of the inner frame 30 is connected pivotally to the pivot stile of the outer frame 20. The open stile of the inner frame 30 corresponds to the open stile of the outer frame 20. When the inner frame 30 pivots relative to the outer frame 20, the open stile of the inner frame 30 is selectively closed and opened relative to the outer frame 20.

The at least one inner main stop 31 is mounted securely on the outer peripheral surface of the inner frame 30 and corresponds to the open stile of the inner frame 30. Each of the at least one inner main stop 31 has a third stopping protrusion 311 and a fourth stopping protrusion 312. The third stopping protrusion 311 protrudes from the inner main stop 31. The fourth stopping 312 protrudes from the inner main stop 31 and is disposed adjacent to the third stopping protrusion 311. Preferably, the third stopping protrusion 311 and the fourth stopping protrusion 312 are formed in one piece.

The at least one inner secondary stop 32 is mounted securely on the outer peripheral surface of the inner frame 30, corresponds to the open stile of the inner frame 30 and is arranged longitudinally with the at least one inner main stop 31. Each of the at least one inner secondary stop 32 has an inner stopping protrusion 321 protruding from the inner secondary stop 32.

In this preferred embodiment of the multistage lock, the stationary frame 10 has an outer main stop 11 and two outer secondary stops 12, and the inner frame 30 has an inner main stop 31 and two inner secondary stops 32. The outer main stop 11 of the stationary frame 10 is mounted at a middle of the stationary frame 10. The outer secondary stops 12 of the stationary frame 10 are mounted respectively adjacent to a top and a bottom of the stationary frame 10. The inner main stop 31 of the inner frame 30 is mounted at a middle of open stile of the inner frame 30 and corresponds to the outer main stop 11. The inner secondary stops 32 of the inner frame 30 are respectively mounted adjacent to a top and a bottom of open stile of the inner frame 30 and respectively correspond to the outer secondary stops 12 of the stationary frame 10. Furthermore, the third stopping protrusion 311 of the inner main stop 31 corresponds to the first stopping protrusion 111 of the outer main stop 11 and the fourth stopping protrusion 312 of the inner main stop 31 is disposed between the first and second stopping protrusions 111, 112 of the outer main stop 11.

The lock device 40 is mounted on the open stile of the outer frame 20 and has an outer sliding panel 41, at least one outer main limiting protrusion 411 and at least one outer secondary limiting protrusion 412, an inner sliding panel 42, at least one inner main limiting protrusion 421, at least one inner secondary limiting protrusion 422 and a handle assembly 43.

Figure 4:
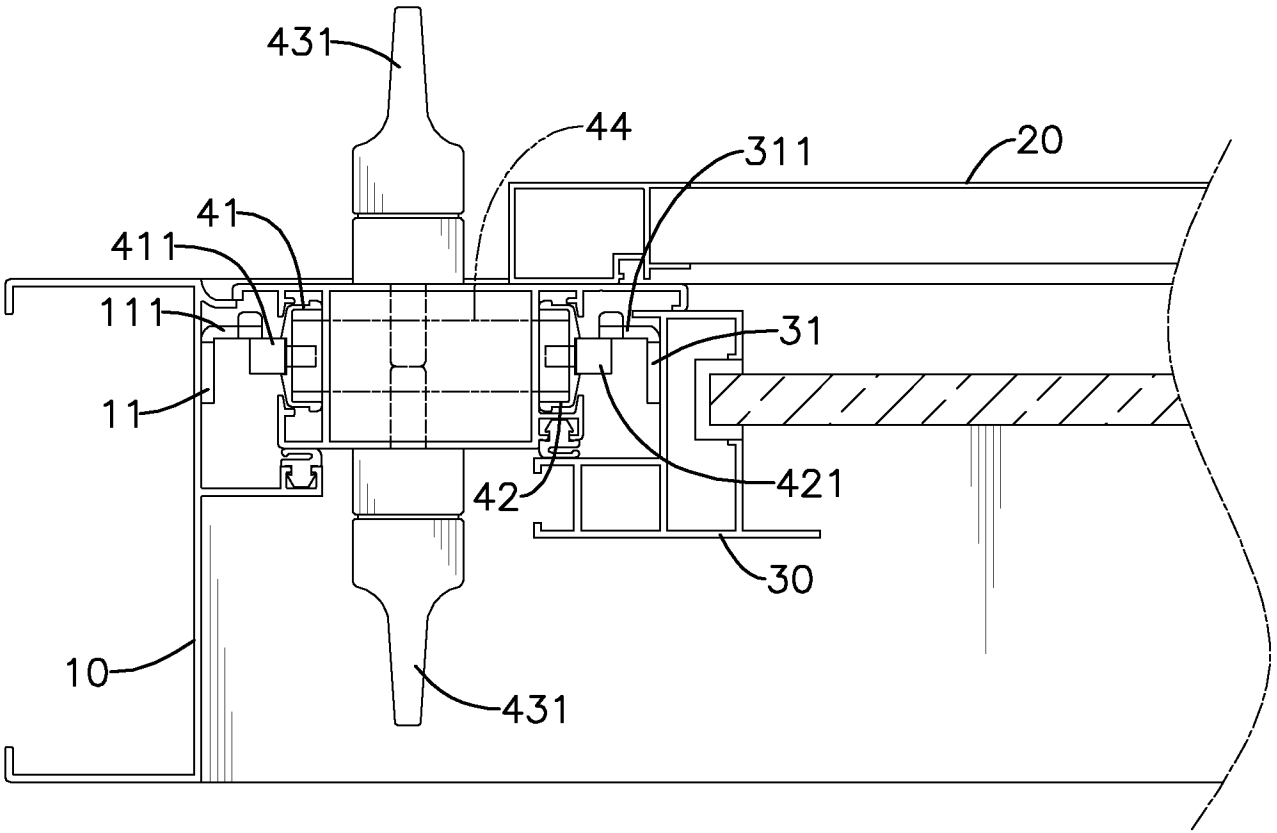
FIG. 4 is an enlarged top view in partial section of the multistage lock in FIG. 1, shown the closed outer frame and inner frame.

With further reference to FIG. 4, the outer sliding panel 41 is elongated, is mounted on the outer peripheral surface of the outer frame 20 and corresponds to the open stile of the outer frame 20. The at least one outer main limiting protrusion 411 is mounted on the outer siding panel 41. Each of the at least one outer main limiting protrusion 411 corresponds to one of the at least one outer main stop 11 of the stationary frame 10 and selectively engages the first and second stopping protrusions 111, 112 of the outer main stop 11. The at least one outer secondary limiting protrusion 412 is mounted on the outer sliding panel 41. Each of the at least one outer secondary limiting protrusion 412 corresponds to one of the at least one outer secondary stop 12 of the stationary frame 10 and selectively engages the outer stopping protrusion 121 of the outer secondary stop 12.

The inner sliding panel 42 is elongated, is mounted on the inner peripheral surface of the outer frame 20 and corresponds to the open stile of the outer frame 20. The at least one inner main limiting protrusion 421 is mounted on the inner sliding panel 42. Each of the at least one inner main limiting protrusion 421 corresponds to one of the at least one inner main stop 31 of the inner frame 30 and selectively engages the third and fourth stopping protrusions 311, 312 of the inner main stop 31. The at least one inner secondary limiting protrusion 422 is mounted on the inner sliding panel 42. Each of the at least one inner secondary limiting protrusion 422 corresponds to one of the at least one inner secondary stop 32 of the inner frame 30 and selectively engages the inner stopping protrusion 321 of the inner secondary stop 32.

The handle assembly 43 is mounted on the outer frame 20, is connected to the outer and inner sliding panels 41, 42 and has at least one handle 431. The at least one handle 431 is mounted on outer frame 20, and is connected to and drives the outer and inner sliding panels 41, 42. Preferably, the handle assembly 43 has two handles 431. The handles 431 are mounted respectively on an interior surface and an exterior surface of the outer frame 20, and are connected to and driven by each other. Thus, when one of the handles 431 is turned, the outer and inner sliding panels 41, 42 slide up or down.

The handle assembly 43 may be connected to one of the outer and inner sliding panels 41, 42, and the outer sliding panel 41 and the inner sliding panel 42 are further connected to each other through a connector 44. Thus, when the handle assembly 43 is turned, the outer and inner sliding panels 41, 42 slide toward simultaneously the same direction.

Figure 9:
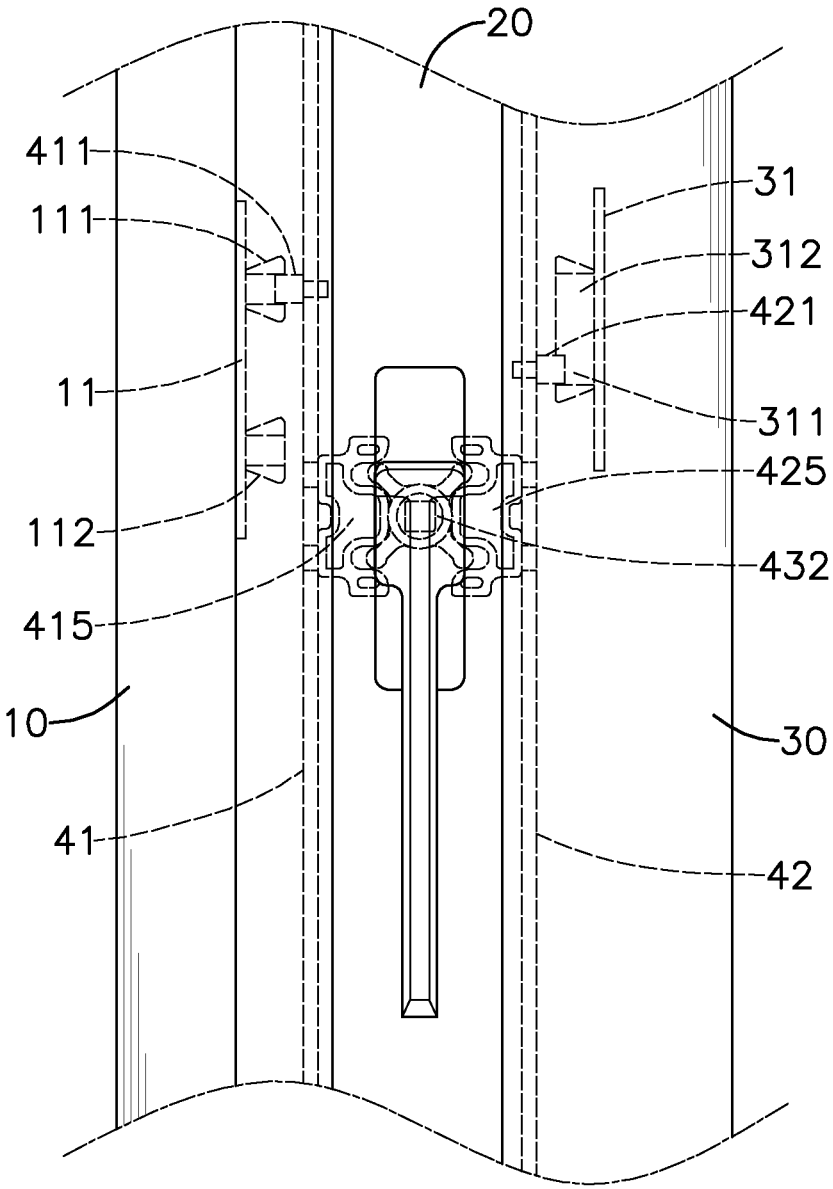
FIG. 9 is an enlarged front view of a second embodiment of a multistage lock in accordance with the present invention, shown an outer sliding panel and an inner sliding panel sliding toward opposite directions.

Otherwise, with further reference to FIG. 9, in a second preferred embodiment of the multistage lock in accordance with the present invention, the handle assembly 43 may further have a driven rotor 432. The driven rotor 432 is connected securely to and is driven by the at least one handle 431 of the handle assembly 43, and engages two transmission connectors 415, 425 mounted respectively on the outer and inner sliding panels 41, 42. Thus, when the handle assembly 43 is turned, the outer and inner sliding panels 41, 42 slide simultaneously toward opposite directions.

The following description describes that the outer and inner sliding panels 41, 42 slide toward the same direction.

With reference to FIGS. 1 to 4, when the at least one outer main limiting protrusion 411 on the outer sliding panel 41 engages the first stopping protrusion 111 of the outer main stop 11 and the at least one outer secondary limiting protrusion 412 on the outer sliding panel 41 engages the outer stopping protrusion 121 of the outer secondary stop 12, the outer frame 20 is closed relative to the stationary frame 10. Moreover, when the at least one inner main limiting protrusion 421 on the inner sliding panel 42 engages the third stopping protrusion 311 of the inner main stop 31 and the at least one inner secondary limiting protrusion 422 on the inner sliding panel 42 engages the inner stopping protrusion 321 of the inner secondary stop 32, the inner frame 30 is closed relative to the outer frame 20. Namely, the outer frame 20 and the inner frame 30 are both closed.

Figure 5:
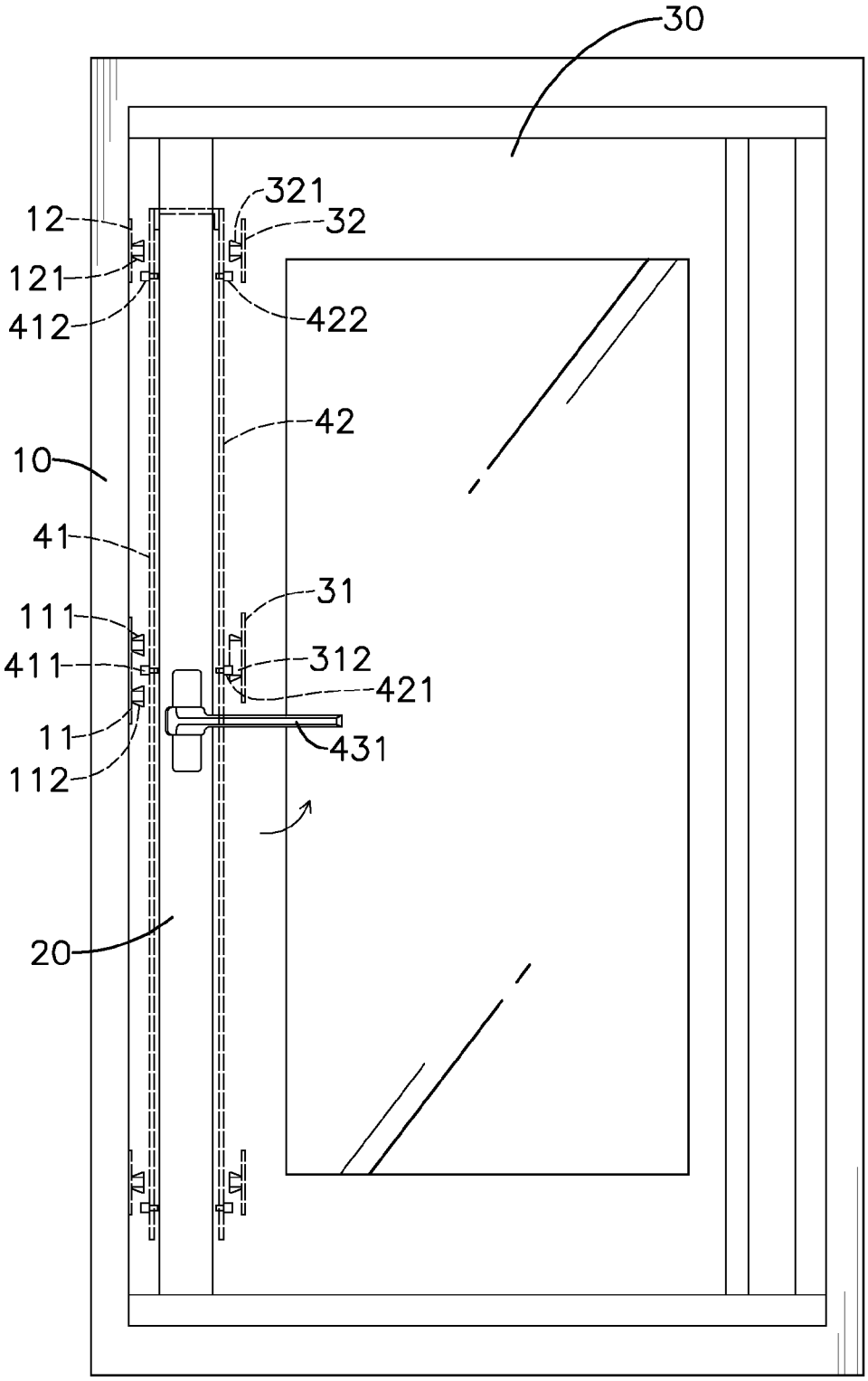
FIG. 5 is a front view of the multistage lock in FIG. 1, shown the opened outer frame and the closed inner frame.
Figure 6:
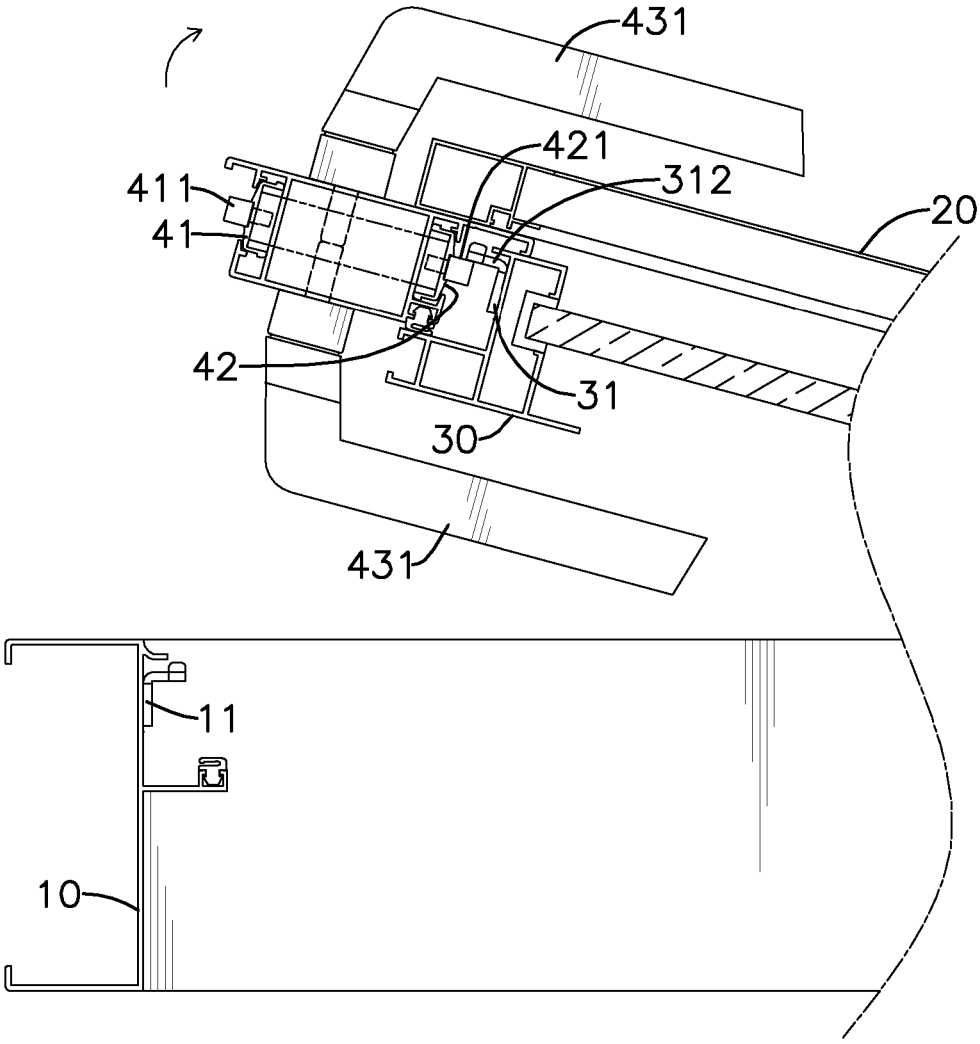
FIG. 6 is an enlarged top view in partial section of the multistage lock in FIG. 1, shown the opened outer frame and the closed inner frame.

With further reference to FIGS. 5 and 6, as the at least one handle 431 is turned, the outer and inner sliding panels 41, 42 slide down simultaneously. Then, while the at least one inner secondary limiting protrusion 422 on the inner sliding panel 42 departs from the inner stopping protrusion 321 of the inner secondary stop 32, the inner main limiting protrusion 421 on the inner sliding panel 42 still engages the fourth stopping protrusion 312 of the inner main stop 31. Therefore, the inner frame 30 is still closed relative to the outer frame 20. Nevertheless, since the at least one outer main limiting protrusion 411 on the outer sliding panel 41 is disposed between the first and second stopping protrusions 111, 112 of the outer main stop 11 and the at least one outer secondary limiting protrusion 412 on the outer sliding panel 41 departs from the outer stopping protrusion 121 of the outer secondary stop 12, the outer frame 20 is opened relative to the stationary frame 10. Thus, when the outer frame 20 is pushed, the outer and inner frames 20, 30 pivot simultaneously and are opened relative to the stationary frame 10.

Figure 7:
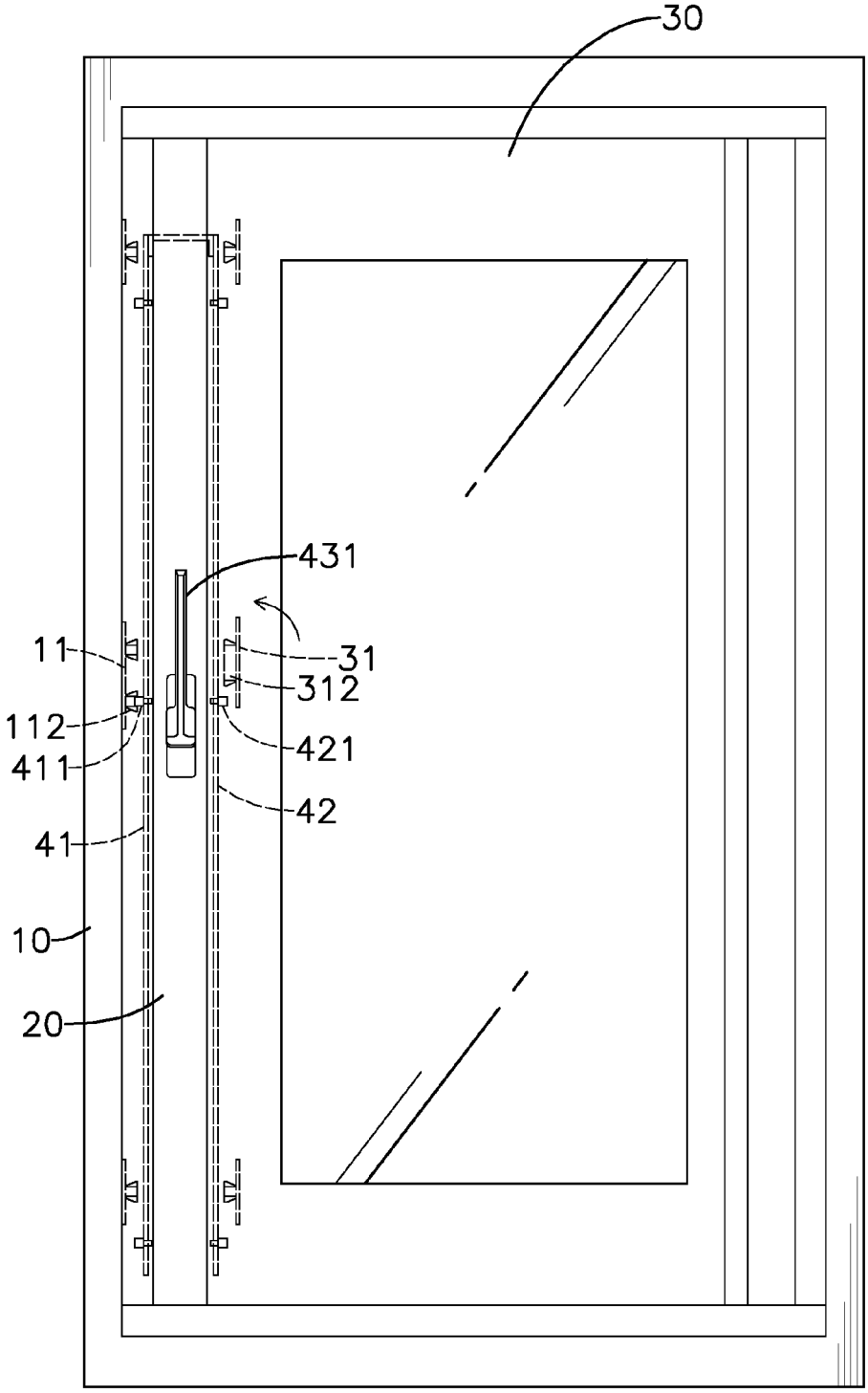
FIG. 7 is a front view of the multistage lock in FIG. 1, shown the opened outer frame and inner frame.
Figure 8:
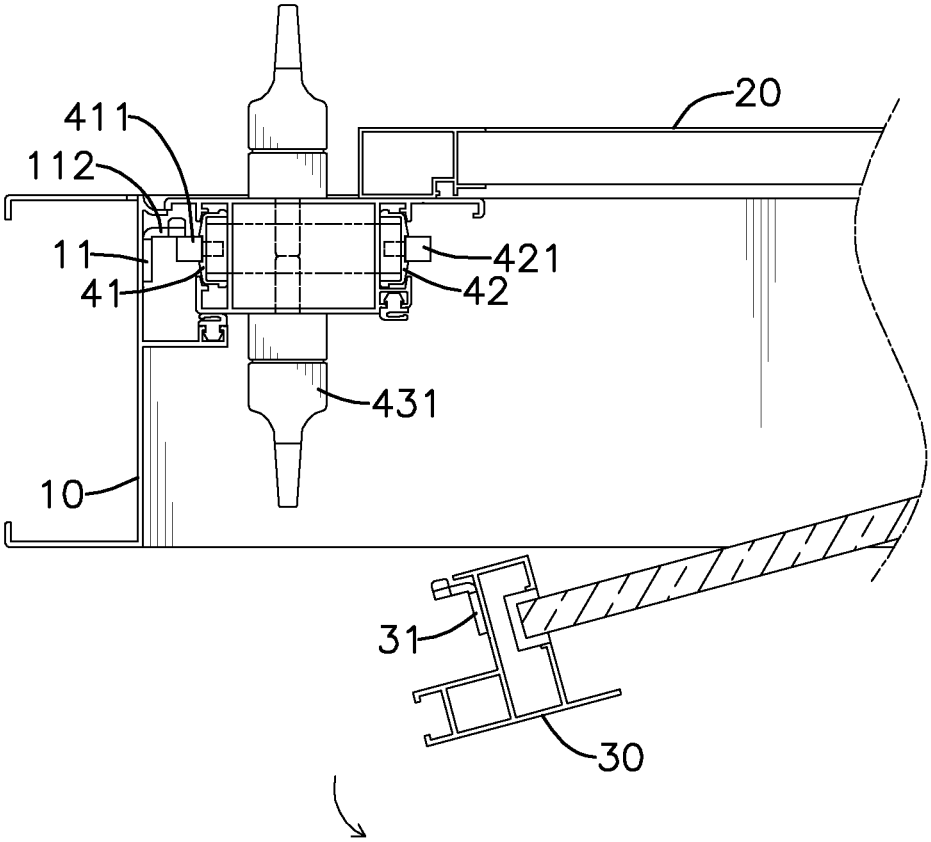
FIG. 8 is an enlarged top view in partial section of the multistage lock in FIG. 1, shown the opened outer frame and inner frame.

With further reference to FIGS. 7 and 8, as the at least one handle 431 is further turned and the outer and inner sliding panels 41, 42 further slide down, the at least one inner main limiting protrusion 421 on the inner sliding panel 42 departs from the fourth stopping protrusion 312 of the inner main stop 31 so the inner frame 30 is opened relative to the outer frame 20. Nevertheless, the at least one outer main limiting protrusion 411 on the outer sliding panel 41 engages the second stopping protrusion 112 of the outer main stop 11 so the outer frame 20 is closed relative to the stationary frame 10. Then, when the inner frame 30 is pulled, the inner frame 30 is opened relative to the outer frame 20. People can first view and determine the outdoor situation therethrough before deciding whether to open the door panel (window) or not.

Figure 10:
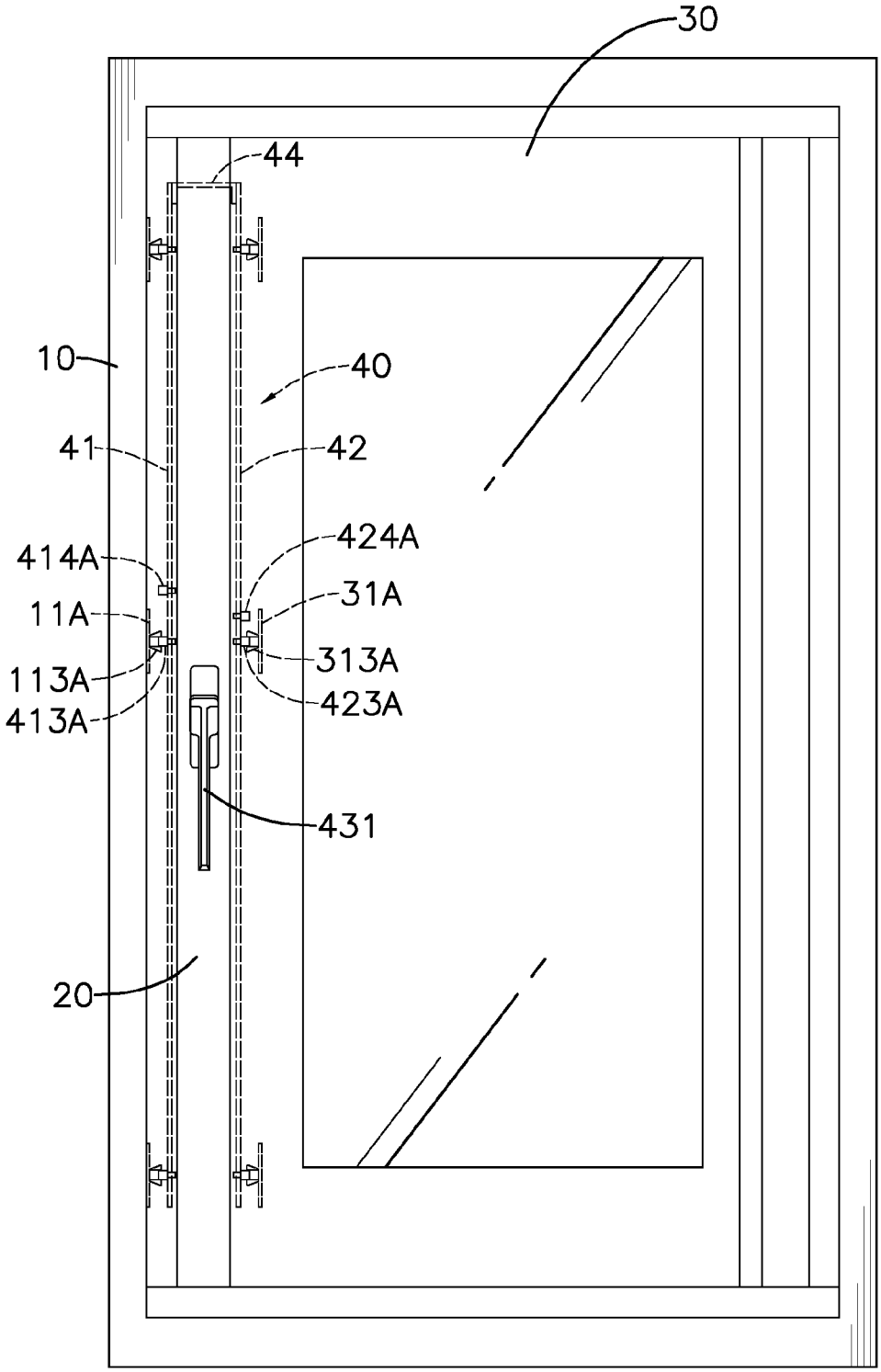
FIG. 10 is a front view of a third embodiment of a multistage lock in accordance with the present invention, shown a closed outer frame and inner frame.

With further reference to FIG. 10, in a third preferred embodiment of the multistage lock in accordance with the present invention, each of the at least one outer main stop 11A of the stationary frame 10 has a stopping protrusion 113A protruding from the outer main stop 11A, and each of the at least one outer main stop 31A of the inner frame 30 has a stopping protrusion 313A protruding from the inner main stop 31A.

The lock device 40 has at least one first outer main limiting protrusion 413A, at least one second outer main limiting protrusion 414A, at least one third inner main limiting protrusion 423A and at least one fourth inner main limiting protrusion 424A.

The at least one first outer main limiting protrusion 413A is mounted on the outer sliding panel 41. The at least one second outer main limiting protrusion 414A is mounted on the outer sliding panel 41. Each of the at least one second outer main limiting protrusion 414A is separated from a corresponding one of the at least one first outer main limiting protrusion 413A. Thus, a gap is defined between the second outer main limiting protrusion 414A and the first outer main limiting protrusion 413A. Each of the at least one first outer main limiting protrusion 413A and each of the at least one second outer main limiting protrusion 414A correspond to one of the at least one outer main stop 11 A and selectively engage with the stopping protrusion 113A of the outer main stop 11A.

The at least one third inner main limiting protrusion 423A is mounted on the inner sliding panel 42. The at least one fourth inner main limiting protrusion 424A is mounted on the inner sliding panel 42. Each of the at least one fourth inner main limiting protrusion 424A is disposed adjacent to a corresponding one of the at least one third inner main limiting protrusion 423A. Each of the at least one third inner main limiting protrusion 423A and each of the at least one fourth inner main limiting protrusion 424A correspond to one of the at least one inner main stop 31A and selectively engage the stopping protrusion 313A of the inner main stop 31A.

Thus, when the at least one first outer main limiting protrusion 413A on the outer sliding panel 41 engages the stopping protrusion 113A of a corresponding outer main stop 11A and the at least one third inner main limiting protrusion 423A of the inner sliding panel 42 engages the stopping protrusion 313A of the a corresponding inner main stop 31A, the outer frame 20 is closed relative to the stationary frame 10 and the inner frame 30 is also closed relative to the outer frame 20.

Figure 11:
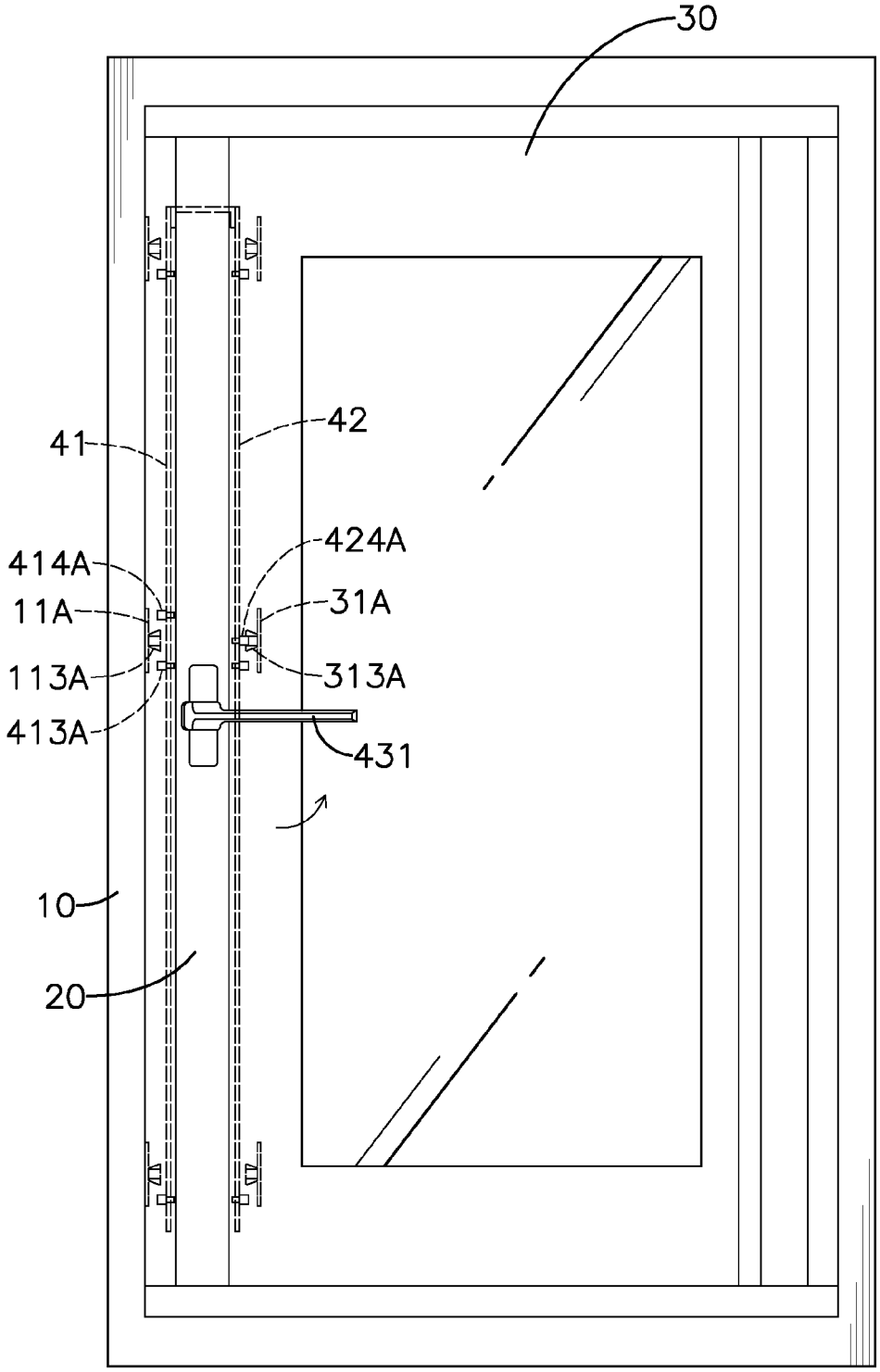
FIG. 11 is a front view of the multistage lock in FIG. 10, shown the opened outer frame and inner frame.

With further reference to FIG. 11, as the at least one handle 431 is turned, the outer and inner sliding panels 41, 42 slide down simultaneously. Then, while the at least one fourth inner main limiting protrusion 424A on the sliding panel 42 engages the stopping protrusion 313A of the corresponding outer main stop 31A, the stopping protrusion 113A of the at least one outer main stop 11A is disposed between the first corresponding outer main limiting protrusion 413A and second outer main limiting protrusion 414A of the outer sliding panel 41. Thus, the inner frame 30 is still closed relative to the outer frame 20. When the outer frame 20 is pushed, the outer and inner frames 20, 30 pivot simultaneously and are opened relative to the stationary frame 10.

Figure 12:
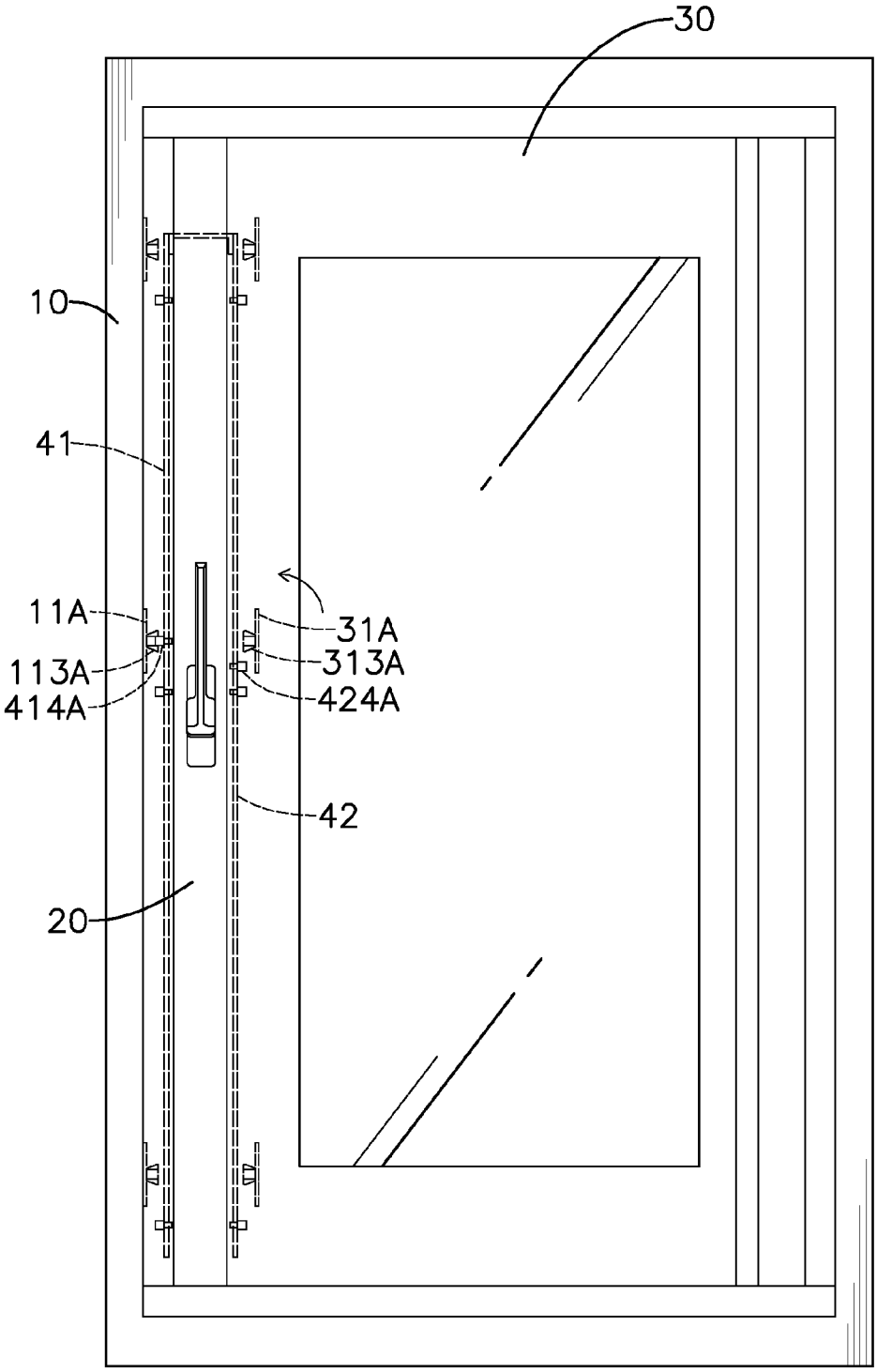
FIG. 12 is a front view of the multistage lock in FIG. 10, shown the opened outer frame and inner frame.

With further reference to FIG. 12, as the at least one handle 431 is further turned, the outer and inner sliding panels 41, 42 further slide down. While the at least one fourth inner main limiting protrusion 424A on the inner sliding panel 42 is departed from the stopping protrusion 313A of the corresponding inner main stop 31A, the at least one second outer main limiting protrusion 414A of the outer sliding panel 41 engages the stopping protrusion 113A of the corresponding outer main stop 11A. Then, the outer frame 20 is closed relative to the stationary frame 10, and when the inner frame 30 is pulled, the inner frame 30 is opened relative to the outer frame 20.

The multistage lock as described has the following advantages. According to relative positions of the stopping protrusions 111, 112, 121, 311, 312, 321, 113A, 313A of the stops 11, 12, 31, 32, 11A, 31A and the limiting protrusions 411, 412, 421, 422, 413A, 414A, 423A, 424A on the sliding panels 41, 42, the limiting protrusions 411, 412, 421, 422, 413A, 414A, 423A, 424A on the sliding panels 41, 42 selectively engage and are departed from the stopping protrusions 111, 112, 121, 311, 312, 321, 113A, 313A of the stops 11, 12, 31, 32, 11A, 31A when the at least one handle 431 is turned. Consequently, the inner and outer frames 20 are selectively opened. The multistage lock has a simplified structure and allows people to decide whether the door panel (window) is opened or not according to the situation and weather outdoors.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multistage lock comprising:

a stationary frame being an annular framework and having an inner peripheral surface; and at least one outer main stop mounted securely on the inner peripheral surface of the stationary frame, and each of the at least one outer main stop having a first stopping protrusion protruding from the outer main stop; and a second stopping protrusion protruding from the outer main stop and separated from the first stopping protrusion of the outer main stop to form a gap defined between the first stopping protrusion and the second stopping protrusion;

an outer frame being an annular framework, mounted in and connected pivotally to the stationary frame, and having an outer peripheral surface;

an inner peripheral surface;

a pivot stile connected pivotally to the stationary frame; and an open stile corresponding to the at least one outer main stop;

an inner frame mounted in and connected pivotally to the outer frame, and having an outer peripheral surface;

a pivot stile connected pivotally to the pivot stile of the outer frame;

an open stile corresponding to the open stile of the outer frame; and at least one inner main stop mounted securely on the outer peripheral surface of the inner frame and corresponding to the open stile of the inner frame, and each of the at least one inner main stop having a third stopping protrusion protruding from the inner main stop; and a fourth stopping protrusion protruding from the inner main stop and disposed adjacent to the third stopping protrusion of the inner main stop; and a lock device mounted on the open stile of the outer frame and having an outer sliding panel being elongated, mounted on the outer peripheral surface of the outer frame and corresponding to the open stile of the outer frame;

at least one outer main limiting protrusion mounted on the outer sliding panel, and each of the at least one outer main limiting protrusion corresponding to one of the at least one outer main stop of the stationary frame and selectively engaging with the first and second stopping protrusions of the outer main stop;

an inner sliding panel being elongated, mounted on the inner peripheral surface of the outer frame and corresponding to the open stile of the outer frame;

at least one inner main limiting protrusion mounted on the inner sliding panel, and each of the at least one inner main limiting protrusion corresponding to one of the at least one inner main stop of the inner frame and selectively engaging with the third and fourth stopping protrusions of the inner main stop; and a handle assembly mounted on the outer frame, connected to the outer and inner sliding panels and having at least one handle mounted on the outer frame, and connected to and driving the outer and inner sliding panels;

wherein when the at least one handle is turned to allow the at least one outer main limiting protrusion on the outer sliding panel to engage with the first stopping protrusion of the outer main stop and the at least one inner main limiting protrusion on the inner sliding panel to engage with the third stopping protrusion of the inner main stop, the outer frame is closed relative to the stationary frame and the inner frame is closed relative to the outer frame;

when the at least one handle is turned to allow the at least one outer main limiting protrusion on the outer sliding panel to be disposed between the first and second stopping protrusions of the outer main stop and the at least one inner main limiting protrusion on the inner sliding panel to engage with the fourth stopping protrusion of the inner main stop, the outer frame is opened relative to the stationary frame and the inner frame is closed relative to the outer frame; and when the at least one handle is turned to allow the at least one outer main limiting protrusion on the outer sliding panel to engage with the second stopping protrusion of the outer main stop and the at least one inner main limiting protrusion on the inner sliding panel to depart from the third and fourth stopping protrusions of the inner main stop, the outer frame is closed relative to the stationary frame and the inner frame is opened relative to the outer frame.

2. The multistage lock as claimed in claim 1, wherein the stationary frame further has at least one outer secondary stop mounted securely on the inner peripheral surface of the stationary frame and arranged longitudinally with the at least one outer main stop, and each of the at least one outer secondary stop has an outer stopping protrusion protruding from the outer secondary stop;

the inner frame further has at least one inner secondary stop mounted securely on the outer peripheral surface of the inner frame, corresponding to the open stile of the inner frame and arranged longitudinally with the at least one inner main stop, and each of the at least one inner secondary stop has an inner stopping protrusion protruding from the inner secondary stop; and the lock device further has at least one outer secondary limiting protrusion mounted on the outer sliding panel, and each of the at least one outer secondary limiting protrusion corresponding to one of the at least one outer secondary stop of the stationary frame and selectively engaging with the outer stopping protrusion of the outer secondary stop; and at least one inner secondary limiting protrusion mounted on the inner sliding panel, and each of the at least one inner secondary limiting protrusion corresponding to one of the at least one inner secondary stop of the inner frame and selectively engaging with the inner stopping protrusion of the inner secondary stop.

3. The multistage lock as claimed in claim 2, wherein the third stopping protrusion and the fourth stopping protrusion of the at least one inner main stop are formed in one piece.

4. The multistage lock as claimed in claim 2, wherein the handle assembly has two handles mounted respectively on an interior surface and an exterior surface of the outer frame, and connected to and driven by each other.

* * * * *